US010041275B2

(12) United States Patent
Wu

(10) Patent No.: US 10,041,275 B2
(45) Date of Patent: Aug. 7, 2018

(54) COMBINATION LOCK STRUCTURE FOR SIMPLE PASSWORD RETRIEVAL

(71) Applicant: XIAMEN MAKE SECURITY TECHNOLOGY CO., LTD., Xiamen (CN)

(72) Inventor: Feng Wu, Xiamen (CN)

(73) Assignee: XIAMEN MAKE SECURITY TECHNOLOGY CO., LTD., Xiamen, Fujian (CN)

( * ) Notice: Subject to any disclaimer, the term of this patent is extended or adjusted under 35 U.S.C. 154(b) by 0 days.

(21) Appl. No.: 15/533,040

(22) PCT Filed: May 19, 2015

(86) PCT No.: PCT/CN2015/079264

§ 371 (c)(1),
(2) Date: Jun. 5, 2017

(87) PCT Pub. No.: WO2016/123883

PCT Pub. Date: Aug. 11, 2016

(65) Prior Publication Data

US 2018/0106072 A1 Apr. 19, 2018

(30) Foreign Application Priority Data

Feb. 5, 2015 (CN) ..... 2015 2 0081730 U

(51) Int. Cl.
*E05B 37/02* (2006.01)
*E05B 37/00* (2006.01)

(52) U.S. Cl.
CPC ..... *E05B 37/0058* (2013.01); *E05B 37/0034* (2013.01); *E05B 37/02* (2013.01)

(58) Field of Classification Search
CPC .. E05B 37/02; E05B 37/0058; E05B 37/0034; E05B 37/0031; E05B 37/0041; E05B 37/0037
USPC .... 70/21, 213, 284, 285, 312, 446, DIG. 63, 70/DIG. 71
See application file for complete search history.

(56) References Cited

U.S. PATENT DOCUMENTS 7,628,047 B2 * 12/2009 Lee ..... E05B 37/0034 70/134
7,958,757 B1 * 6/2011 Lee ..... E05B 13/103 70/21
8,316,675 B2 * 11/2012 Yang ..... E05B 13/103 70/21

(Continued)

*Primary Examiner* — Lloyd A Gall
(74) *Attorney, Agent, or Firm* — Leong C. Lei

(57) ABSTRACT

A combination lock structure for simple password retrieval is provided. An inner sleeve is formed with a V-shaped groove. A clamping plate is provided with a V-shaped angle corresponding to the V-shaped groove. A hasp plate is provided with a hasp. A cylindrical flange of the inner sleeve is formed with a hasp groove for engagement of the hasp. A lower end of the hasp plate is provided with a convex point. A lock cylinder is formed with a protrusion corresponding to the convex point. When the lock cylinder is turned to an unlocked position, the protrusion urges the convex point to move upward and the hasp is moved upward so that the hasp is pressed against the cylindrical flange. When the hasp is engaged in the hasp groove, the V-shaped angle is engaged in the V-shaped groove.

10 Claims, 1 Drawing Sheet

(56) References Cited

U.S. PATENT DOCUMENTS

| | | | | |
|---|---|---|---|---|
| 2011/0083483 | A1* | 4/2011 | Yang | E05B 37/0034 70/284 |
| 2016/0032620 | A1* | 2/2016 | Yu | E05B 37/0034 70/74 |
| 2017/0114567 | A1* | 4/2017 | Taylor | E05B 37/0034 |

* cited by examiner

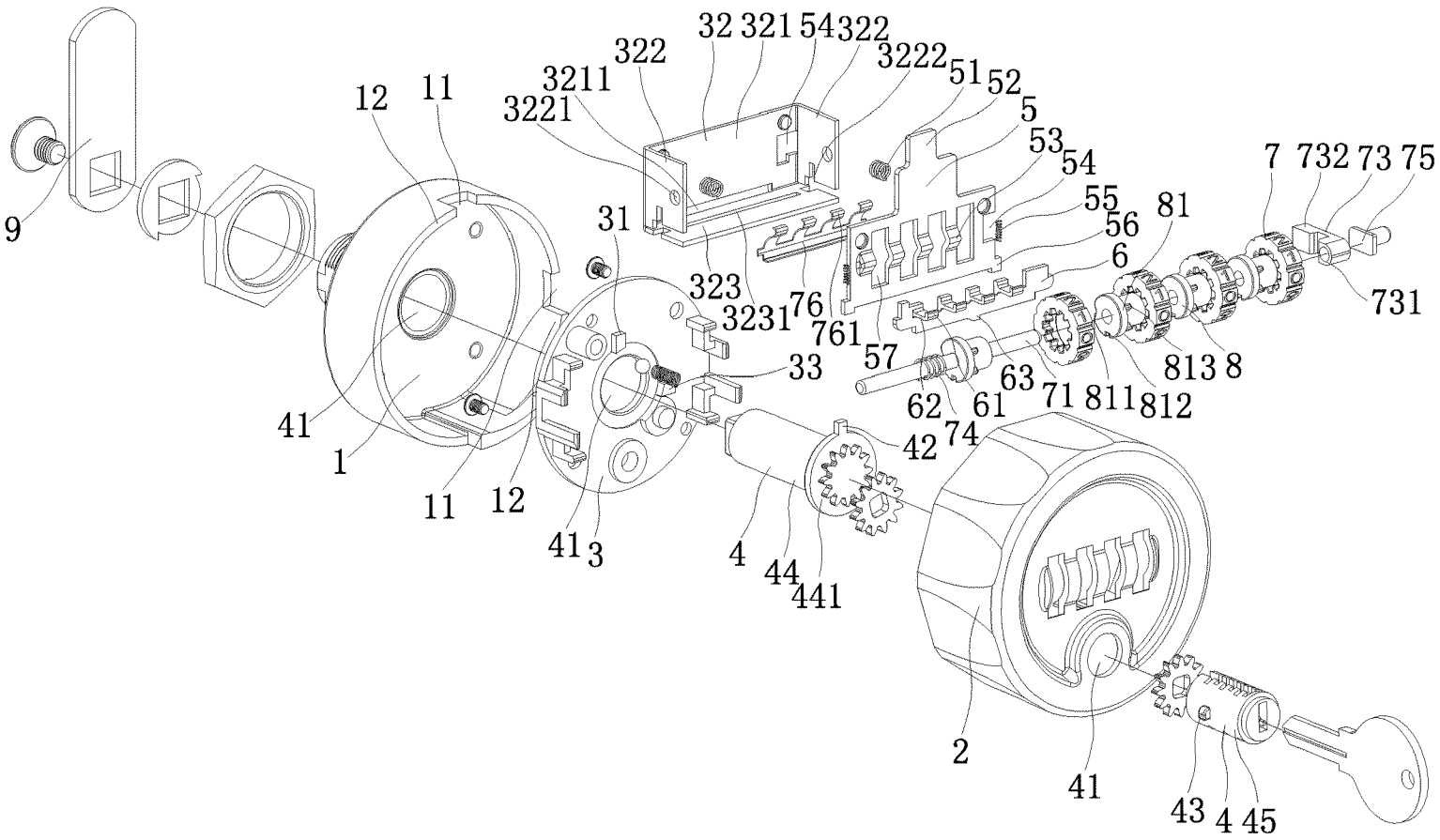
75
73
731
732
7
8
813
81
812
811
71
6
56
55
54
53
5
52
51
3222
322
54
321
32
63
61
74
62
42
57
761
76
33
3231
323
322
3211
3221
31
441
44
4
3
41
12
11
1
9
2
41
43
4
45

COMBINATION LOCK STRUCTURE FOR SIMPLE PASSWORD RETRIEVAL

BACKGROUND OF THE INVENTION

1. Field of the Invention

The present invention relates to a combination lock structure for simple password retrieval.

2. Description of the Prior Art

A mechanical combination lock has the feature of high security. The existing mechanical combination locks generally have the function of changing the password. Before changing the password, it is necessary to enter the correct password. In reality, the user may forget the password. For these users, they cannot open the combination lock again or change a password that is easy to recall.

Accordingly, the present invention intends to provide a dual faucet structure for improving the shortcomings mentioned above.

SUMMARY OF THE INVENTION

The primary object of the present invention is to provide a combination lock structure for simple password retrieval. When the user forgets the password, he/she can retrieve the password.

In order to achieve the aforesaid object, the combination lock structure for simple password retrieval of the present invention comprises a round lock base, a round housing, a fixing seat, a lock cylinder, a clamping plate, a hasp plate, character wheels, a pivot, inner sleeves, and a latch. The fixing seat is fixedly mounted in the round housing. The round housing is rotatably mounted on the round lock base. The round lock base, the fixing seat and the round housing each have a lock cylinder mounting hole for installing the lock cylinder. The latch is fixedly mounted at a rear end of the lock cylinder. The lock cylinder is formed with a protruding block. The fixing seat is formed with an unlocking block to mate with the protruding block. When the fixing seat is rotated, the unlocking block drives the protruding block and the lock cylinder to turn in the direction of unlocking.

The clamping plate is mounted on the fixing seat. The clamping plate is provided with a clamping plate installation assembly. An edge of the clamping plate is formed with an angular stop. The round lock base is formed with an engaging notch corresponding to the angular stop. The round housing is unable to be rotated when the angular stop is engaged in the engaging notch. A compression spring is mounted between the clamping plate and the fixing seat. The clamping plate can be pushed by the compression spring to disengage the angular stop from the engaging notch.

The character wheels are pivotally connected on the pivot through the respective inner sleeves. The pivot with the character wheels is pivotally connected to the fixing seat. The inner sleeves are rotated along with the respective character wheels. One end of each of the inner sleeves extends radially outwardly to form a cylindrical flange. The cylindrical flange is formed with a V-shaped groove. The clamping plate is provided with a V-shaped angle projecting outwardly and corresponding to the V-shaped groove. When the V-shaped angle is inserted into the V-shaped groove, the clamping plate is biased by the compression spring to disengage the angular stop from the engaging notch.

The hasp plate is mounted on the fixing seat and located below the inner sleeves. The fixing seat is provided with a hasp plate installation seat, enabling the hasp plate to move in the direction of the inner sleeves. The hasp plate is provided with a hasp. The hasp is connected to the hasp plate through an elastic plate. The cylindrical flange is formed with a hasp groove corresponding to the hasp. A convex point is formed at a lower end of the hasp plate. A protrusion corresponding to the convex point is formed on the lock cylinder. When the lock cylinder is turned to an unlocked position, the protrusion urges the convex point to move upward and the hasp is moved upward so that the hasp is pressed against the cylindrical flange. When the hasp is engaged in the hasp groove, the V-shaped angle is engaged in the V-shaped groove.

Preferably, the hasp groove and the V-shaped groove are arranged at an angle of 90 degrees on the cylindrical flange.

Preferably, each of the inner sleeves is a cylinder having a central through hole through which the pivot passes. The cylinder is provided with a plurality of axial raised teeth. The character wheels each have a central pivot hole. The pivot hole is formed with a plurality of equidistant axial grooves. The inner sleeves are engaged with the axial grooves through the axial raised teeth to be rotated along with the respective character wheels so that the inner sleeves can be axially moved along the pivot. One end of the pivot is sleeved with an engaging block. Another end of the pivot is sleeved with a return spring. One side of the engaging block is formed with a cylindrical surface which faces an end face of the inner sleeve opposite the cylindrical flange. Another side of the engaging block, opposite the cylindrical surface, is provided with a push button. The push button extends out of the round housing. When the push button is pushed, the engaging block is pushed to move the inner sleeves so that the axial raised teeth disengage from the axial grooves of the character wheels.

Preferably, the fixing seat is fixedly mounted with a fixing frame. The fixing frame includes a rear plate, two side plates, and a lower plate. The two side plates are formed with pivot holes. The pivot with the character wheels is pivotally connected to the pivot holes. The clamping plate is engaged between the two side plates. The compression spring is mounted between the clamping plate and the rear plate. The engaging block is formed with a square rear portion. The rear plate and the clamping plate are formed with square recesses for installing the square rear portion. The square rear portion is engaged in the square recess of the clamping plate so that the clamping plate is only moved axially along the lock cylinder.

Preferably, the round lock base is formed with two baffle plates located at a locked position and the unlocked position respectively. The two baffle plates are higher than the trajectory of the angular stop. The round lock base is formed with two engaging notches located at the locked position and the unlocked position respectively for engagement of the angular stop. Preferably, the lock cylinder includes a lock cylinder tail and a lock cylinder body. An end of the lock cylinder tail has a shoulder. The shoulder is engaged in the lock cylinder mounting hole of the fixing seat. The lock cylinder body is mounted at a side of the lock cylinder tail. The ends of the lock cylinder tail and the lock cylinder body are provided with gears to mesh with each other. The protruding block is disposed on the lock cylinder tail. The protrusion is disposed on the lock cylinder body.

Preferably, the fixing seat is provided with an elastic member. The elastic member has contacts. The contacts are pressed against the character wheels. A gap is defined between every two of digits of each character wheel.

Preferably, the clamping plate is formed with slots for accommodating the character wheels. The fixing seat is provided with a limit baffle. When the lock cylinder is turned to the unlocked position by a key, the protruding block is stopped by the limit baffle.

Alternatively, the fixing seat is fixedly mounted with a fixing frame. The fixing frame includes a rear plate, two side plates, and a lower plate. The two side plates are formed with pivot holes. The pivot with the character wheels is pivotally connected to the pivot holes. The clamping plate is engaged between the two side plates. The compression spring is mounted between the clamping plate and the rear plate. The fixing seat is mounted with a square block. The rear plate and the clamping plate are formed with square recesses for installing the square block. The square block is engaged in the square recess of the clamping plate so that the clamping plate is only moved axially along the lock cylinder. The fixing seat is provided with an elastic member. The elastic member has contacts. The contacts are pressed against the character wheels. The rear plate is formed with an elastic member mounting groove through which the contacts of the elastic member pass. The lower plate is formed with a hasp plate mounting groove for insertion of the hasp plate.

Preferably, the round housing is threadedly connected to the fixing seat. A spring is provided between the clamping plate and the fixing seat. The clamping plate is formed with a lower corner. Each of the two side plates of the fixing frame is formed with a lower corner mounting groove. One end of the spring is mounted over the lower corner. Another end of the spring is mounted to an upper wall of the lower corner mounting groove.

Thereby, the combination lock of the present invention can be opened by using the key to turn the lock cylinder in the situation that the user knows the password or forgets the password. Through the design of the V-shaped angle of the clamping plate and the V-shaped groove of the inner sleeve, the clamping plate can be engaged with or disengaged from the engaging notch, thereby allowing the round housing to be turned to open the combination lock through the unlocking block.

The steps to retrieve the password are as followings:

First, the key is inserted to turn the lock cylinder to the unlocked position. At this moment, the protrusion urges the convex point to move upward and the hasp is moved upward to lean against the cylindrical flange.

Then, the character wheels are turned to rotate the inner sleeves until the hasp biased by the elastic plate is engaged in the hasp groove. At this moment, the character wheels cannot be further turned. Since the positions of the hasp groove and the V-shaped groove satisfy the positions where the hasp is engaged in the hasp groove and the V-shaped angle is also engaged in the V-shaped groove, the password is correct. In this way, the operation to retrieve the password is very simple.

BRIEF DESCRIPTION OF THE DRAWINGS

FIG. 1 is an exploded view in accordance with an embodiment of the present invention.

DETAILED DESCRIPTION OF THE PREFERRED EMBODIMENTS

Embodiments of the present invention will now be described, by way of example only, with reference to the accompanying drawings.

As shown in FIG. 1, the present invention discloses a combination lock structure for simple password retrieval comprises a round lock base 1, a round housing 2, a fixing seat 3, a lock cylinder 4, a clamping plate 5, a hasp plate 6, character wheels 7, a pivot 71, inner sleeves 8, and a latch 9.

The fixing seat 3 is fixedly mounted in the round housing 2. The round housing 2 is rotatably mounted on the round lock base 1. The round lock base 1, the fixing seat 3 and the round housing 2 each have a lock cylinder mounting hole 41 for installation of the lock cylinder 4. The latch 9 is fixedly mounted at a rear end of the lock cylinder 4. A key is inserted into the lock cylinder 4 and turned to open the lock.

Another means of unlocking is to form a protruding block 42 on the lock cylinder 4. The fixing seat 3 is formed with an unlocking block 31 to mate with the protruding block 42. When the fixing seat 3 is rotated, the unlocking block 31 drives the protruding block 42 and the lock cylinder 4 to turn in the direction of unlocking, thereby opening the combination lock.

The fixing seat 3 is fixedly mounted with a fixing frame 32. The fixing frame 32 includes a rear plate 321, two side plates 322, and a lower plate 323.

The clamping plate 5 is disposed between the two side plates 322. A compression spring 51 is mounted between the clamping plate 5 and the rear plate 321. The clamping plate 5 is biased by the compression spring 51. An edge of the clamping plate 5 is formed with an angular stop 52. The round lock base 1 is formed with an engaging notch 11 corresponding to the angular stop 52. When the angular stop 52 is placed in the engaging notch 11, the round housing 2 cannot be rotated. When the angular stop 52 is pushed out of the engaging notch 11 by the compression spring 51, the round housing 2 can be rotated.

Each of the character wheels 7 is engraved with 0-9 digits which are arranged at equal distances. The two side plates 322 are formed with pivot holes 3221. The character wheels 7 are pivotally connected on the pivot 71 through the respective inner sleeves 8. The pivot 71 with the character wheels 7 is pivotally connected to the pivot holes 3221. The inner sleeves 8 can be rotated along with the respective character wheels 7.

One end of each inner sleeve 8 extends radially outwardly to form a cylindrical flange 81. The cylindrical flange 81 is formed with a V-shaped groove 811. The clamping plate 5 is provided with a V-shaped angle projecting outwardly and corresponding to the V-shaped groove 811. The character wheels 7 are rotated to turn the inner sleeves 8. When the V-shaped angle 53 is fully inserted into the V-shaped groove 811, the password is right and the clamping plate 5 is biased by the compression spring 51 to move so that the angular stop 52 disengages from the engaging notch 11. At this moment, the round housing 2 can be turned to open the combination lock.

Similarly, when locked, the round housing 2 is turned to the locked position, i.e., the angular stop 52 is returned to the engaging notch 11, and the character wheels 7 are turned to upset the password. At this moment, because the V-shaped angle 53 is not fully engaged in V-shaped groove 811, the V-shaped angle 53 is moved by the inner sleeve 8 in the direction of the engaging notch 11, so that the angular stop 52 is engaged in the engaging notch 11 again to complete the locking.

The lower plate 323 of the fixing frame 32 is formed with a hasp plate mounting groove 3231. The hasp plate 6 is insertedly disposed in the hasp plate mounting groove 3231.

The hasp plate 6 is located below the inner sleeves 8 so that the hasp plate 6 can be moved up and down in the hasp plate mounting groove 3231.

The hasp plate 6 is provided with a hasp 61. The hasp 61 is connected to the hasp plate 6 through an elastic plate 62. The cylindrical flange 81 is formed with a hasp groove 812. The hasp 61 can be engaged in the hasp groove 812. A convex point 63 is formed at a lower end of the hasp plate 6. A protrusion 43 corresponding to the convex point 63 is formed on the lock cylinder 4. When the lock cylinder 4 is turned to the unlocked position, the protrusion 43 urges the convex point 63 to move upward and the hasp 61 is moved upward. At this moment, the hasp 61 is pressed against the cylindrical flange 81. The character wheels 7 are turned to rotate the inner sleeves 8 until the hasp 61 biased by the elastic plate 62 is engaged in the hasp groove 812. At this moment, the character wheel 7 cannot be further turned. Because the positions of the hasp groove 812 and the V-shaped groove 811 satisfy the positions where the hasp 61 is engaged in the hasp groove 812 and the V-shaped angle 53 is also engaged in the V-shaped groove 811, all the character wheels 7 are turned until they cannot be further turned, and the password is correct. In this way, the user can retrieve the forgotten password.

When the lock cylinder 4 is rotated in the direction of locking, the protrusion 43 is moved away from the convex point 63 and the hasp 61 loses the support to move downward away from the hasp groove 812. The lock cylinder 4 is rotated to the locked position to upset the password to complete the locking. Locking requires a key to turn the lock cylinder 4.

The round housing 2 is threadedly connected to the fixing seat 3 so that the round housing 2 is rotatable about the round lock base 1. In order to facilitate the installation of the round housing 2, a tension spring 55 is provided between the clamping plate 5 and the fixing seat 32. The clamping plate 5 is formed with a lower corner 56. Each of the side plates 322 of the fixing frame 32 is formed with a lower corner mounting groove 3222. The lower corner mounting groove 3222 may be formed on the fixing seat 3. One end of the tension spring 55 is mounted over the lower corner 56, and the other end of the tension spring 55 is mounted to an upper wall of the lower corner mounting groove 3222. When the round housing 2 is mounted, the clamping plate 5 is first pressed down to be placed in the fixing seat 3. At this moment, the tension spring 55 is elongated, and then the round housing 2 is rotated until the clamping plate 5 is turned to the engaging notch 11 of the fixing seat 3. By the pulling of the tension spring 55, the angular stop 52 of the clamping plate 5 extends into the engaging notch 11 to complete the installation. Since the clamping plate 5 is held against the upper wall of the lower corner mounting groove 3222 by the tension spring 55 during use, the clamping plate 5 won't be moved up and down during use to meet the requirement of the axial movement along the lock cylinder 4.

The hasp groove 812 and the V-shaped groove 811 are preferably arranged at an angle of 90 degrees on the cylindrical flange 81, which is beneficial for the structural design and arrangement of the clamping plate 5 and the hasp plate 6.

In order to change the password, the inner sleeve 8 is designed to be a cylinder having a central through hole through which the pivot 71 passes. The cylinder is provided with a plurality of axial raised teeth 813. The number of the axial raised teeth 813 may be one or more. The character wheels 7 each have a central pivot hole. The pivot hole is formed with a plurality of equidistant axial grooves 72. The number of the axial grooves 72 is the same as the number of the digits of each character wheel 7. Each inner sleeve 8 is engaged with the axial grooves 72 through the axial raised teeth 813 to be rotated along with the corresponding character wheel 7. Because the raised teeth and the axial grooves are axially arranged, they can be axially moved along the pivot 71.

One end of the pivot 71 is sleeved with an engaging block 73, and another end of the pivot 71 is sleeved with a return spring 74. One side of the engaging block 73 is formed with a cylindrical surface 731 which faces an end face of the inner sleeve 8 opposite the cylindrical flange 81. Another side of the engaging block 73, opposite the cylindrical surface 731, is provided with a push button 75. The push button 75 extends out of the round housing 2. When the push button 75 is pushed, the engaging block 73 is pushed to move the inner sleeves 8, so that the axial raised teeth 813 disengage from the axial grooves 72 of the character wheels 7.

When the password is changed, the character wheels 7 are first rotated to the correct password position, the push button 75 is pushed to disengage the inner sleeves 8 from the character wheels 7, the character wheels 7 are rotated to the desired password position, the push button 75 is released, and the inner sleeves 8 biased by the return spring 74 are inserted in the character wheels 7 again to complete the change of the password.

The installation of the clamping plate may be achieved through a square block which is disposed on the fixing seat 3 and perpendicular to the fixing seat 3. The clamping plate 5 is formed with a square recess 54. The square block is inserted into the square recess 54, such that the clamping plate 5 can be axially moved along the lock cylinder 4. When the clamping plate 5 is mounted on the fixing frame 32, the rear plate 321 may be formed with the square recess 54. The engaging block 73 may be formed with a square rear portion 732, instead of the aforesaid square block. Because the engaging block 73 is to be moved, the square recess 54 is characterized by a width in the direction of the two side plates 322. Since the clamping plate 5 is engaged between the two side plates 322 of the fixing frame 32, the clamping plate 5 won't move in the direction of the two side plates 322 due to the width of the square recess 54.

In order to prevent the round housing 2 from being rotated too much when the round housing 2 is turned to unlock or when the round housing 2 is turned by a key to lock, the round lock base 1 is formed with two baffle plates 12 located at the locked position and the unlocked position respectively. The two baffle plates 12 are higher than the trajectory of the angular stop 52, so that the angular stop 52 can only be rotated between the two baffle plates 12. The two baffle plates 12 may be directly formed by heightening the two sides of the engaging notch 11.

The round lock base 1 is formed with two engaging notches 52 located at the locked position and the unlocked position respectively for engagement of the angular stop 52. This design allows the clamping plate 5 to be moved at the locked position and the unlocked position, so that the character wheels 7 can be rotated at these two positions to complete the change of the password.

In order to locate the character wheels 7 in the middle of the round housing 2 and in order to make the configuration more compact to reduce the installation space, the lock cylinder 4 includes two parts, a lock cylinder tail 44 and a lock cylinder body 45. An end of the lock cylinder tail 44 has a shoulder 441. The shoulder 441 is engaged in the lock cylinder mounting hole 41 of the fixing seat 3. The lock cylinder body 45 is mounted at a side of the lock cylinder tail 44. The ends of the lock cylinder tail 44 and the lock cylinder body 45 are provided with gears to mesh with each other. The protruding block 42 is disposed on the lock cylinder tail 44. The protrusion 43 is disposed on the lock cylinder body 45.

The fixing seat 3 is provided with an elastic member 76. The elastic member 76 has contacts 761. The rear plate 321 of the fixing frame 32 is formed with an elastic member mounting groove 3211 through which the contacts 761 of the elastic member 76 pass. The contacts 761 are pressed against the character wheels 7. A gap is defined between every two of the digits of each character wheel 7. When the character wheels 7 are rotated and the contacts 761 are engaged in the respective gaps and there is a sense of click, so that the user can know whether or not the character wheels Tare rotated in place. In this way, the V-shaped angle 53 can be accurately engaged in the V-shaped groove 811. When the password is changed, the inner sleeves 8 can be accurately pushed into the character wheels 7 by the return spring 74.

Since the diameter of the cylindrical flange 81 of the inner sleeve 8 is less than that of the character wheel 7, the clamping plate 5 is formed with slots 57 for accommodating the character wheels 7, so that the clamping plate 5 doesn't interfere with the character wheels 7.

In order to ensure that the lock cylinder 4 is turned to the unlocked position by the key for the protrusion 43 of the lock cylinder 4 to jack up the convex point 63 of the hasp plate 6, the fixing seat 3 is provided with a limit baffle 33. When the lock cylinder 4 is turned to the unlocked position by the key, the protruding block 42 is stopped by the limit baffle 33 so that the key cannot be further turned to ensure that the lock cylinder 4 just stays at the position where the protrusion 43 jacks up the convex point 63 of the hasp plate 6 so that the retrieval of the password can be successfully carried out.

The two engaging notches 11 are arranged at an angle of 90 degrees on the round lock base 1. The unlocking bock 31 and the limit baffle 33 are also arranged at an angle of 90 degrees. That is, the round housing 2 or the key is rotated by 90 degrees to open the lock, which may be other angles according to the actual needs. In this embodiment, the clockwise rotation is to open the lock.

Although particular embodiments of the present invention have been described in detail for purposes of illustration, various modifications and enhancements may be made without departing from the spirit and scope of the present invention. Accordingly, the present invention is not to be limited except as by the appended claims.

What is claimed is:

1. A combination lock structure for simple password retrieval, comprising a round lock base, a round housing, a fixing seat, a lock cylinder, a clamping plate, a hasp plate, character wheels, a pivot, inner sleeves, and a latch; the fixing seat being fixedly mounted in the round housing, the round housing being rotatably mounted on the round lock base, the round lock base, the fixing seat and the round housing each having a lock cylinder mounting hole for installing the lock cylinder, the latch being fixedly mounted at a rear end of the lock cylinder;

the lock cylinder being formed with a protruding block, the fixing seat being formed with an unlocking block to mate with the protruding block, wherein when the fixing seat is rotated, the unlocking block drives the protruding block and the lock cylinder to turn in the direction of unlocking;

the clamping plate being mounted on the fixing seat, the clamping plate being provided with a clamping plate installation assembly; an edge of the clamping plate being formed with an angular stop, the round lock base being formed with an engaging notch corresponding to the angular stop, the round housing being unable to be rotated when the angular stop is engaged in the engaging notch, a compression spring being mounted between the clamping plate and the fixing seat, wherein the clamping plate can be pushed by the compression spring to disengage the angular stop from the engaging notch;

the character wheels being pivotally connected on the pivot through the respective inner sleeves, the pivot with the character wheels being pivotally connected to the fixing seat, the inner sleeves being rotated along with the respective character wheels, one end of each of the inner sleeves extending radially outwardly to form a cylindrical flange, the cylindrical flange being formed with a V-shaped groove, the clamping plate being provided with a V-shaped angle projecting outwardly and corresponding to the V-shaped groove, wherein when the V-shaped angle is inserted into the V-shaped groove, the clamping plate is biased by the compression spring to disengage the angular stop from the engaging notch;

the hasp plate being mounted on the fixing seat and located below the inner sleeves, the fixing seat being provided with a hasp plate installation seat, enabling the hasp plate to move in the direction of the inner sleeves, the hasp plate being provided with a hasp, the hasp being connected to the hasp plate through an elastic plate, the cylindrical flange being formed with a hasp groove corresponding to the hasp; a convex point being formed at a lower end of the hasp plate, a protrusion corresponding to the convex point being formed on the lock cylinder, wherein when the lock cylinder is turned to an unlocked position, the protrusion urges the convex point to move upward and the hasp is moved upward so that the hasp is pressed against the cylindrical flange; wherein when the hasp is engaged in the hasp groove, the V-shaped angle is engaged in the V-shaped groove.

2. The combination lock structure for simple password retrieval as claimed in claim 1, wherein the hasp groove and the V-shaped groove are arranged at an angle of 90 degrees on the cylindrical flange.

3. The combination lock structure for simple password retrieval as claimed in claim 1, wherein each of the inner sleeves is a cylinder having a central through hole through which the pivot passes, the cylinder is provided with a plurality of axial raised teeth, the character wheels each have a central pivot hole, the pivot hole is formed with a plurality of equidistant axial grooves, the inner sleeves are engaged with the axial grooves through the axial raised teeth to be rotated along with the respective character wheels so that the inner sleeves can be axially moved along the pivot; one end of the pivot is sleeved with an engaging block, another end of the pivot is sleeved with a return spring, one side of the engaging block is formed with a cylindrical surface which faces an end face of the inner sleeve opposite the cylindrical flange, another side of the engaging block, opposite the cylindrical surface, is provided with a push button, the push button extends out of the round housing, when the push button is pushed, the engaging block is pushed to move the inner sleeves so that the axial raised teeth disengage from the axial grooves of the character wheels.

4. The combination lock structure for simple password retrieval as claimed in claim 3, wherein the fixing seat is fixedly mounted with a fixing frame, the fixing frame includes a rear plate, two side plates, and a lower plate, the two side plates are formed with pivot holes, the pivot with the character wheels is pivotally connected to the pivot holes; the clamping plate is engaged between the two side plates, the compression spring is mounted between the clamping plate and the rear plate, the engaging block is formed with a square rear portion, the rear plate and the clamping plate are formed with square recesses for installing the square rear portion, and the square rear portion is engaged in the square recess of the clamping plate so that the clamping plate is only moved axially along the lock cylinder.

5. The combination lock structure for simple password retrieval as claimed in claim 1, wherein the round lock base is formed with two baffle plates located at a locked position and the unlocked position respectively, the two baffle plates are higher than the trajectory of the angular stop; and the round lock base is formed with two engaging notches located at the locked position and the unlocked position respectively for engagement of the angular stop.

6. The combination lock structure for simple password retrieval as claimed in claim 1, wherein the lock cylinder includes a lock cylinder tail and a lock cylinder body, an end of the lock cylinder tail has a shoulder, the shoulder is engaged in the lock cylinder mounting hole of the fixing seat, the lock cylinder body is mounted at a side of the lock cylinder tail, the ends of the lock cylinder tail and the lock cylinder body are provided with gears to mesh with each other, the protruding block is disposed on the lock cylinder tail, and the protrusion is disposed on the lock cylinder body.

7. The combination lock structure for simple password retrieval as claimed in claim 1, wherein the fixing seat is provided with an elastic member, the elastic member has contacts, the contacts are pressed against the character wheels, and a gap is defined between every two of digits of each character wheel.

8. The combination lock structure for simple password retrieval as claimed in claim 1, wherein the clamping plate is formed with slots for accommodating the character wheels; the fixing seat is provided with a limit baffle, when the lock cylinder is turned to the unlocked position by a key, the protruding block is stopped by the limit baffle.

9. The combination lock structure for simple password retrieval as claimed in claim 1, wherein the fixing seat is fixedly mounted with a fixing frame, the fixing frame includes a rear plate, two side plates, and a lower plate, the two side plates are formed with pivot holes, the pivot with the character wheels is pivotally connected to the pivot holes; the clamping plate is engaged between the two side plates, the compression spring is mounted between the clamping plate and the rear plate, the fixing seat is mounted with a square block, the rear plate and the clamping plate are formed with square recesses for installing the square block, the square block is engaged in the square recess of the clamping plate so that the clamping plate is only moved axially along the lock cylinder; the fixing seat is provided with an elastic member, the elastic member has contacts, the contacts are pressed against the character wheels, the rear plate is formed with an elastic member mounting groove through which the contacts of the elastic member pass; and the lower plate is formed with a hasp plate mounting groove for insertion of the hasp plate.

10. The combination lock structure for simple password retrieval as claimed in claim 9, wherein the round housing is threadedly connected to the fixing seat, a spring is provided between the clamping plate and the fixing seat, the clamping plate is formed with a lower corner, each of the two side plates of the fixing frame is formed with a lower corner mounting groove, one end of the spring is mounted over the lower corner, and another end of the spring is mounted to an upper wall of the lower corner mounting groove.

* * * * *